US010106344B2

(12) United States Patent
Yamaguchi

(10) Patent No.: US 10,106,344 B2
(45) Date of Patent: Oct. 23, 2018

(54) SHEET STACKING DEVICE AND IMAGE FORMING APPARATUS INCLUDING THE SAME

(71) Applicant: KYOCERA Document Solutions Inc., Osaka-shi, Osaka (JP)

(72) Inventor: Yoshihiro Yamaguchi, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/795,061

(22) Filed: Oct. 26, 2017

(65) Prior Publication Data

US 2018/0118478 A1 May 3, 2018

(30) Foreign Application Priority Data

Oct. 28, 2016 (JP) ..... 2016-211718

(51) Int. Cl.

| | |
|---|---|
| ***B65H 1/22*** | (2006.01) |
| ***B65H 1/26*** | (2006.01) |
| ***B65H 1/04*** | (2006.01) |
| ***B65H 1/28*** | (2006.01) |
| ***G03G 15/00*** | (2006.01) |

(52) U.S. Cl.

CPC ..... *B65H 1/266* (2013.01); *B65H 1/04* (2013.01); *B65H 1/28* (2013.01); *G03G 15/6502* (2013.01); *B65H 2402/544* (2013.01); *B65H 2402/546* (2013.01); *B65H 2405/3311* (2013.01); *B65H 2405/35* (2013.01); *B65H 2801/06* (2013.01)

(58) Field of Classification Search

CPC ..... B65H 2402/544; B65H 2402/546; B65H 2405/3311; B65H 2405/35; B65H 2405/3521; B65H 2405/331

See application file for complete search history.

(56) References Cited

U.S. PATENT DOCUMENTS

| | | | | |
|---|---|---|---|---|
| 4,815,598 A * | 3/1989 | Richter | G11B 23/0236 | 206/387.12 |
| 5,199,695 A | 4/1993 | Nakahata et al. | | |
| 5,393,137 A * | 2/1995 | Bivens | B60N 3/083 | 296/37.9 |
| 7,658,375 B2 * | 2/2010 | Wong | B65H 1/266 | 271/164 |

(Continued)

FOREIGN PATENT DOCUMENTS

JP H0577940 A 3/1993

*Primary Examiner* — Howard J Sanders

(74) *Attorney, Agent, or Firm* — Alleman Hall Creasman & Tuttle LLP

(57) ABSTRACT

In a sheet stacking device, a first sheet storage portion and a second sheet storage portion are arranged in alignment in a width direction of a housing, and supported by the housing so as to move in a front-rear direction perpendicular to the width direction. Biasing members are respectively provided on opposite side surfaces of the first and second sheet storage portions, the opposite side surfaces being adjacent and face each other in the width direction. In a first state where the first and second sheet storage portions are moved frontward from the housing, the biasing members abut on each other and bias the first and second sheet storage portions in directions in which the first and second sheet storage portions separate from each other along the width direction.

7 Claims, 13 Drawing Sheets

(56) References Cited

U.S. PATENT DOCUMENTS

| | | | | |
|---|---|---|---|---|
| 2009/0200728 | A1* | 8/2009 | Sugiyama | B65H 1/266 271/9.01 |
| 2013/0032996 | A1* | 2/2013 | Kubota | B65H 1/266 271/264 |

* cited by examiner

SHEET STACKING DEVICE AND IMAGE FORMING APPARATUS INCLUDING THE SAME

INCORPORATION BY REFERENCE

This application is based upon and claims the benefit of priority from the corresponding Japanese Patent Application No. 2016-211718 filed on Oct. 28, 2016, the entire contents of which are incorporated herein by reference.

BACKGROUND

The present disclosure relates to a sheet stacking device including two sheet storage portions that are arranged in alignment in a width direction, and to an image forming apparatus including a sheet stacking device.

There is known a conventional image forming apparatus in which two sheet cassettes are arranged in alignment in a width direction, wherein the sheet cassettes are independent of each other with respect to an apparatus main body and configured to move in the same direction. In this type of image forming apparatus, when the sheet cassettes are drawn out from the apparatus main body, the sheet storage portions of the sheet cassettes are exposed. This allows the user to store sheets in the sheet storage portions.

SUMMARY

A sheet stacking device according to an aspect of the present disclosure includes a housing, a first sheet storage portion and a second sheet storage portion, opposite side surfaces, and biasing members. The first sheet storage portion and the second sheet storage portion are arranged in alignment in a width direction of the housing, and supported by the housing so as to move in a front-rear direction perpendicular to the width direction. The opposite side surfaces include a side surface of the first sheet storage portion and a side surface of the second sheet storage portion and the side surface of the first sheet storage portion and the side surface of the second sheet storage portion are adjacent and face each other in the width direction. The biasing members are respectively provided on the opposite side surfaces. In a first state where the first sheet storage portion and the second sheet storage portion are moved frontward from the housing, the biasing members abut on each other to bias the first sheet storage portion and the second sheet storage portion in directions in which the first sheet storage portion and the second sheet storage portion separate from each other along the width direction.

An image forming apparatus according to another aspect of the present disclosure includes the sheet stacking device and an image forming portion configured to form an image on a sheet supplied from the first sheet storage portion or the second sheet storage portion of the sheet stacking device.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclusure with reference to the accompanying drawings. It should be noted that the following embodiment is an example of a specific embodiment of the present disclosure and should not limit the technical scope of the present disclosure.

Figure 1:
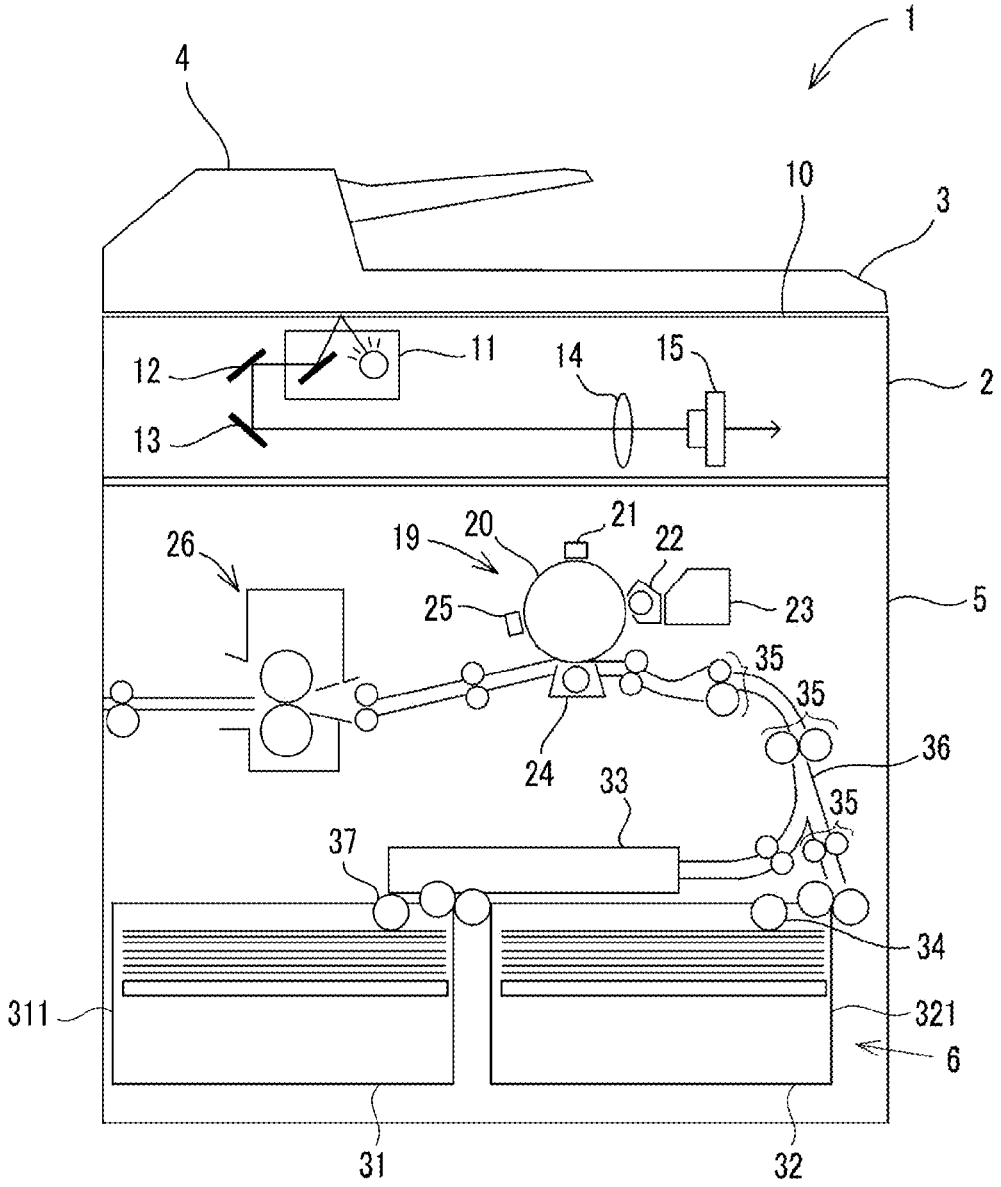
FIG. 1 is a schematic diagram showing an internal configuration of an image forming apparatus according to an embodiment of the present disclosure.

Description is given of a configuration of an image forming apparatus 1 according to an embodiment of the present disclosure. The image forming apparatus 1 is a multifunction peripheral having a plurality of functions such as an image reading function, a facsimile function, and an image forming function. As shown in FIG. 1, the image forming apparatus 1 includes an image reading portion 2, a document sheet cover 3, an auto document feeder (ADF) 4, an image forming portion 5, a sheet stacking device 6, and a conveyance unit 33. Here, a front-rear direction of the image forming apparatus 1 is defined on a supposition that the front side of the plane of FIG. 1 is the front side of the image forming apparatus 1, and the depth side of the plane of FIG. 1 is the rear side of the image forming apparatus 1, and a left-right direction of FIG. 1 is defined as a width direction of the image forming apparatus 1.

The image reading portion 2 executes an image reading process of reading image data from a document sheet conveyed by the ADF 4, or from a document sheet placed on a contact glass 10. As shown in FIG. 1, the image reading portion 2 includes the contact glass 10, a reading unit 11, mirrors 12 and 13, an optical lens 14, and a CCD 15. The image reading portion 2 is well known, and detailed description thereof is omitted.

As shown in FIG. 1, the image forming portion 5 is electrophotographic image forming means that executes an image forming process (print process) based on image data read by the image reading portion 2 or a print job input from an external information processing apparatus such as a personal computer. The image forming portion 5 includes an image transfer portion 19 and a fixing device 26. The image transfer portion 19 includes a photoconductor drum 20, a charging portion 21, a developing portion 22, a toner container 23, a transfer roller 24, and an electricity removing portion 25. In the image forming portion 5, the image forming process based on image data is performed on a paper sheet supplied from the conveyance unit 33. For example, when a print job including a print instruction is input from an external apparatus, the charging portion 21 uniformly charges the photoconductor drum 20 to a predetermined potential. Subsequently, a laser scanning unit (not shown) irradiates light based on image data contained in the print job, to the surface of the photoconductor drum 20. This allows an electrostatic latent image to be formed on the surface of the photoconductor drum 20. The electrostatic latent image on the photoconductor drum 20 is developed (visualized) as a toner image by the developing portion 22. It is noted that toner (developer) is replenished from the toner container 23 to the developing portion 22. Subsequently, the toner image formed on the photoconductor drum 20 is transferred to a paper sheet by the transfer roller 24. After the transfer, the potential of the photoconductor drum 20 is removed by the electricity removing portion 25. The toner image transferred to the paper sheet is heated, fused, and fixed to the paper sheet as the paper sheet passes through the fixing device 26 to be discharged.

Figure 2:
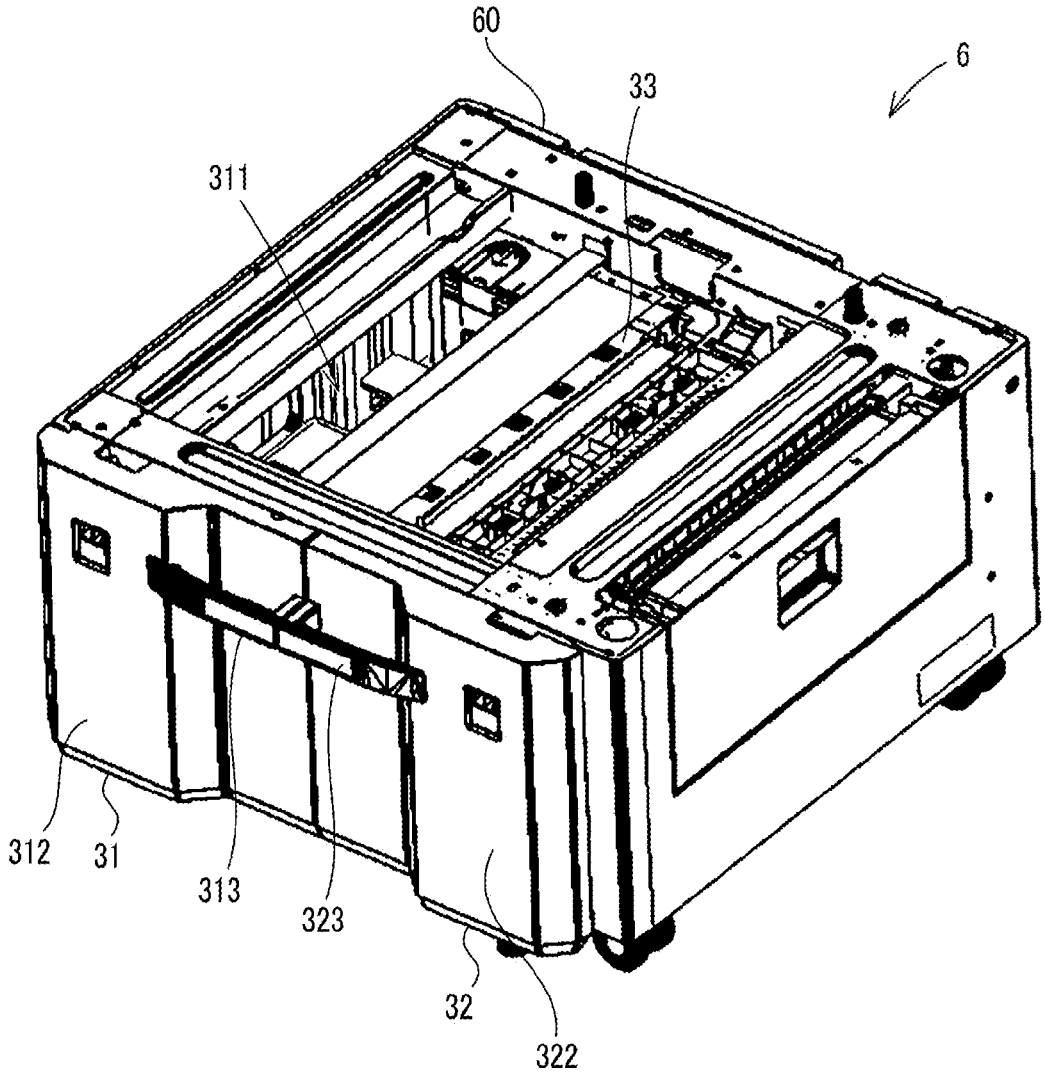
FIG. 2 is an outer appearance perspective diagram of a sheet stacking device.

The sheet stacking device 6 is disposed in a lower portion of the image forming apparatus 1. The sheet stacking device 6 stores paper sheets that are used for images to be formed thereon. As shown in FIG. 1 and FIG. 2, the sheet stacking device 6 includes a first sheet feed cassette 31, a second sheet feed cassette 32, a conveyance unit 33, and a housing 60 in which these components are stored, wherein a plurality of paper sheets are stored in each of the first sheet feed cassette 31 and the second sheet feed cassette 32. The first sheet feed cassette 31, the second sheet feed cassette 32, and the conveyance unit 33 are provided in the housing 60 of the sheet stacking device 6. It is noted that the conveyance unit 33 may not be provided in the sheet stacking device 6, but may be provided in the image forming portion 5.

As shown in FIG. 2, the first sheet feed cassette 31 and the second sheet feed cassette 32 are arranged in the housing 60 of the sheet stacking device 6, in alignment along the width direction of the housing 60.

In the housing 60, the first sheet feed cassette 31 is disposed on the left side in the width direction. The first sheet feed cassette 31 includes a paper sheet storage portion 311 (an example of the first sheet storage portion) and a front panel 312 (an example of the first front panel), wherein the paper sheet storage portion 311 is supported in the housing 60 so as to be slidable in the front-rear direction (the front-rear direction perpendicular to the width direction), and the front panel 312 is provided on the front surface of the paper sheet storage portion 311. The paper sheet storage portion 311 is formed in the shape of a rectangular parallelepiped box with its upper surface opened, and a plurality of paper sheets are stored therein. The front panel 312 is longer in the width direction than the front surface of the paper sheet storage portion 311. The front panel 312 takes a role of a handle that is used to draw out or insert the first sheet feed cassette 31 from/into the housing 60. In addition, in a state where the first sheet feed cassette 31 is attached to the housing 60, the front panel 312 serves as a front exterior panel of the first sheet feed cassette 31.

In the housing 60, the second sheet feed cassette 32 is disposed on the right side in the width direction. The second sheet feed cassette 32 includes a paper sheet storage portion 321 (an example of the second sheet storage portion) and a front panel 322 (an example of the second front panel), wherein the paper sheet storage portion 321 is supported in the housing 60 so as to be slidable in the front-rear direction, and the front panel 322 is provided on the front surface of the paper sheet storage portion 321. As is the case with the paper sheet storage portion 311 of the first sheet feed cassette 31, the paper sheet storage portion 321 is formed in the shape of a rectangular parallelepiped box with its upper surface opened, and a plurality of paper sheets are stored therein. The front panel 322 is longer in the width direction than the front surface of the paper sheet storage portion 321. The front panel 322 takes a role of a handle that is used to draw out or insert the second sheet feed cassette 32 from/into the housing 60. In addition, in a state where the second sheet feed cassette 32 is attached to the housing 60, the front panel 322 serves as a front exterior panel of the second sheet feed cassette 32.

The front panels 312 and 322 are resin molded products. The front panels 312 and 322 are integrally provided with handles 313 and 323 that are held by the user to operate the first sheet feed cassette 31 and the second sheet feed cassette 32, respectively. The first sheet feed cassette 31 is provided in such a way as to be inserted and removed to/from the housing 60 in the front-rear direction of the image forming apparatus 1 as the user operates the handle 313. Similar to the first sheet feed cassette 31, the second sheet feed cassette 32 is provided in such a way as to be inserted and removed to/from the housing 60 in the front-rear direction of the image forming apparatus 1 as the user operates the handle 323.

As shown in FIG. 1, the paper sheets stored in the second sheet feed cassette 32 are taken out one by one by a pick-up roller 34 provided in the housing 60, then conveyed toward the downstream side in the conveyance direction, and further conveyed to the image transfer position by a pair of conveyance rollers 35.

The conveyance unit 33 is disposed above the first sheet feed cassette 31 and the second sheet feed cassette 32. The conveyance unit 33 includes a pick-up roller 37. The conveyance unit 33 causes the pick-up roller 37 to pick up the paper sheets stored in the first sheet feed cassette 31 one by one, conveys the paper sheet toward the downstream side in the conveyance direction, and conveys the paper sheet to a sheet conveyance path 36 between the image forming portion 5 and the second sheet feed cassette 32.

Figure 3A:
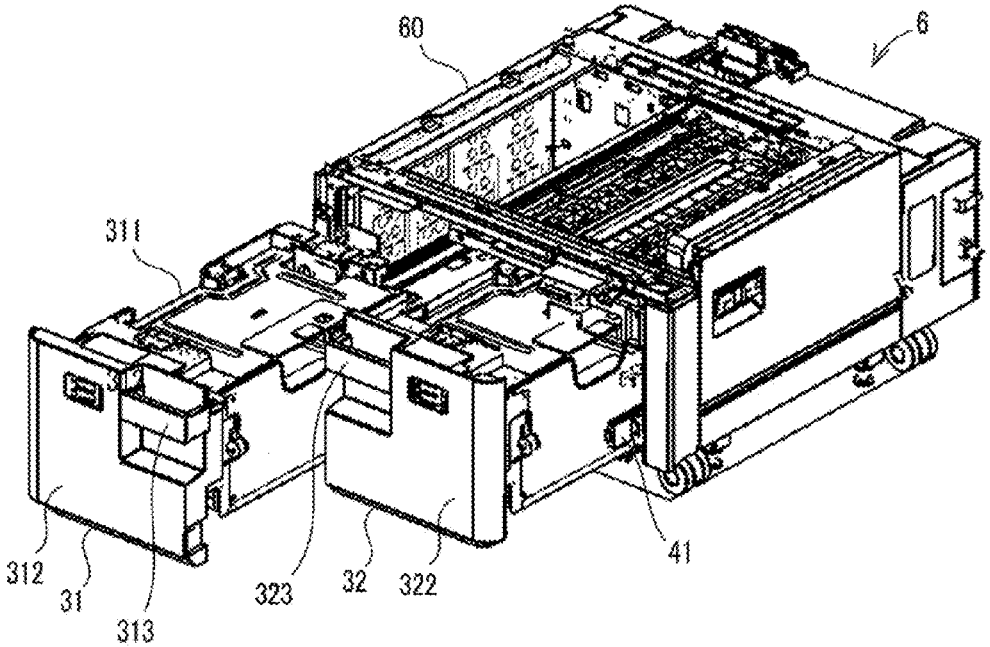
FIG. 3A is a diagram showing a state where a first sheet feed cassette and a second sheet feed cassette are drawn out.
Figure 3B:
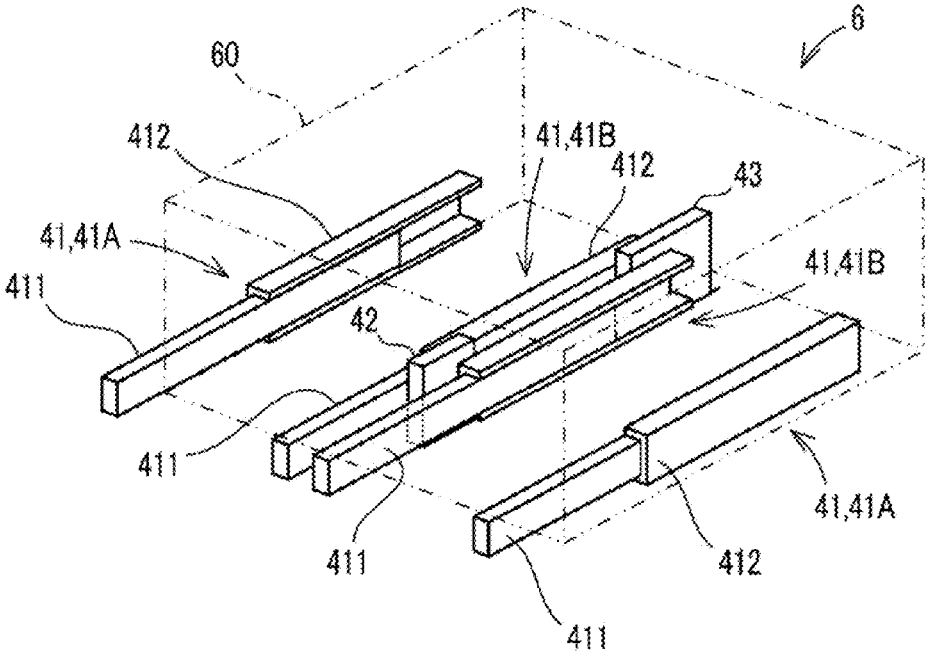
FIG. 3B is a schematic diagram showing positions of slide support portions in the sheet stacking device.

As shown in FIG. 3A, each of the first sheet feed cassette 31 and the second sheet feed cassette 32 is supported by slide support portions 41 (41A and 41B) so as to be slidable in the front-rear direction. As shown in FIG. 3B, four slide support portions 41 are provided. The slide support portions 41 are composed of slide rails 411 and rail guides 412, wherein the slide rails 411 are attached to side surfaces of the paper sheet storage portions 311 and 312 that are opposite in the width direction, and the rail guides 412 are attached to the housing 60. The slide rails 411 are supported by the rail guides 412, thereby the first sheet feed cassette 31 and the second sheet feed cassette 32 are supported so as to be movable in the front-rear direction. In the present embodiment, the slide support portions 41 support the side surfaces of the paper sheet storage portions 311 and 312 that are opposite in the width direction, so as to be movable in the front-rear direction, and specifically, the slide support portions 41 support the lower end portions of the side surfaces of the paper sheet storage portions 311 and 312 that are opposite in the width direction, so as to be movable. As shown in FIG. 3B, a leg portion 42 is formed at a center of a bottom surface of the housing 60 in the width direction so as to project from the bottom surface upward. In addition, a support plate 43 is formed at a center of a rear surface of the housing 60 in the width direction so as to project from the rear surface frontward. The leg portion 42 is provided at a front end of the bottom surface of the housing 60. The support plate 43 is provided at a lower end of the rear surface of the housing 60. The rail guides 412 of slide support portions 41A that are located at ends of the housing 60 opposite in the width direction, are fixed to inner side surfaces of the housing 60 that are opposite in the width direction. Ends opposite in the front-rear direction, of the rail guides 412 of slide support portions 41B that are located at the center in the width direction, are fixed to the leg portion 42 and the support plate 43. It is noted that the slide support portions 41 may include intermediate members between the rail guides 412 and the slide rails 411, wherein the intermediate members are coupled with the rail guides 412 and the slide rails 411 so as to relatively move in the front-rear direction with respect to the rail guides 412 and the slide rails 411.

Figure 4A:
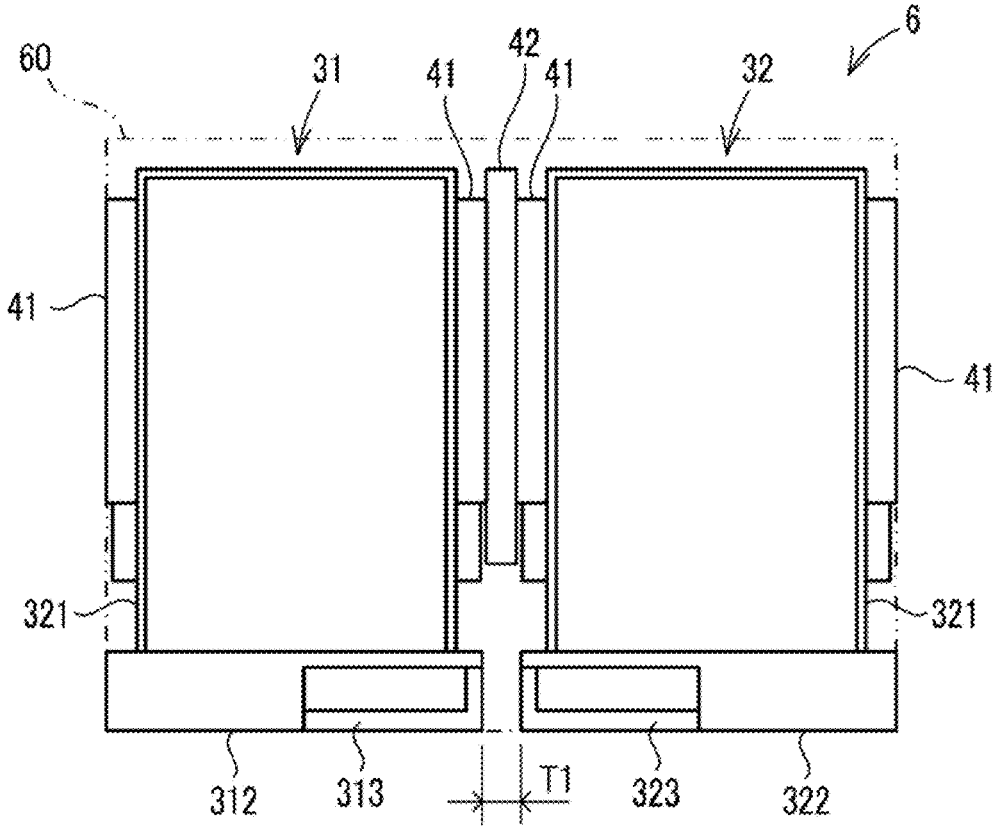
FIG. 4A is a top diagram showing a state where the first and second sheet feed cassettes are stored in a housing.
Figure 4B:
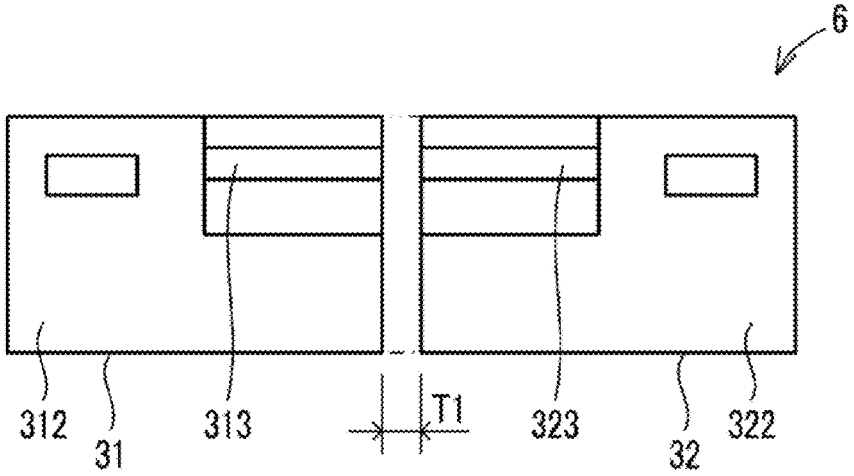
FIG. 4B is a front diagram showing the state where the first and second sheet feed cassettes are stored in the housing.

FIG. 4A and FIG. 4B show a state where the first sheet feed cassette 31 and the second sheet feed cassette 32 are stored in the housing 60. FIG. 4A is a schematic diagram of the sheet stacking device 6 viewed from above. FIG. 4B is a schematic diagram of the sheet stacking device 6 viewed from the front. As shown in FIG. 4A, in the state where the first sheet feed cassette 31 and the second sheet feed cassette 32 are stored in the housing 60, paper sheets can be supplied from the first sheet feed cassette 31 and the second sheet feed cassette 32. Positions of the first sheet feed cassette 31 and the second sheet feed cassette 32 in this state are referred to as attachment positions, and the state where they are disposed at the attachment positions is referred to as attachment state.

In the present embodiment, the sizes of the front panels 312 and 322 and mounting positions thereof at the attachment positions are determined such that a gap T1 having a predetermined interval is formed between the front panel 312 and the front panel 322 in the state where the first sheet feed cassette 31 and the second sheet feed cassette 32 are disposed at the attachment positions. Specifically, in the attachment state where the first sheet feed cassette 31 and the second sheet feed cassette 32 are disposed at the attachment positions, the interval of the gap T1 is approximately 2.0 mm, although there may be a slight error. As described above, since the front panels 312 and 322 serve as the front exterior panels of the first sheet feed cassette 31 and the second sheet feed cassette 32, the front panels 312 and 322 are designed such that the gap T1 is relatively narrow in the attachment state.

Meanwhile, there may be a case where, when the first sheet feed cassette 31 and the second sheet feed cassette 32 are drawn out from the housing 60, the front panels 312 and 322 thereof contact and interfere with each other. This may be caused by, for example: a mounting error of the slide support portions 41 with respect to the housing 60; a mounting error of the front panels 312 and 322 with respect to the paper sheet storage portions 311 and 321; and looseness of the slide support portions 41. Due to such errors and looseness, even when the first sheet feed cassette 31 and the second sheet feed cassette 32 are drawn out to the maximum and disposed at paper sheet storageable positions, the first sheet feed cassette 31 and the second sheet feed cassette 32 may be shifted in the width direction. As a result, even when the gap T1 is formed between the front panels 312 and 322 in the attachment state as described above, if the first sheet feed cassette 31 and the second sheet feed cassette 32 are shifted in the width direction by more than the interval of the gap T1, the front panels 312 and 322 contact and interfere with each other. For example, in a case where such a shift occurs, when the first sheet feed cassette 31 is drawn out from the attachment position while the second sheet feed cassette 32 has been drawn out to the paper sheet storageable position, a corner portion 317 (see FIG. 10) of the front panel 312 at the right front end may contact a corner portion of the front panel 322 at the left rear end, making it difficult to draw out the first sheet feed cassette 31 smoothly. In addition, if the first sheet feed cassette 31 is powerfully drawn out with force, the front panels 312 and 322 may collide with each other and be damaged.

In particular, in a case where each of the first sheet feed cassette 31 and the second sheet feed cassette 32 stores several hundreds of paper sheets, even when the first sheet feed cassette 31 and the second sheet feed cassette 32 are drawn out straight forward, the front panels 312 and 322 may approach and contact each other due to the weights of the first sheet feed cassette 31 and the second sheet feed cassette 32.

Figure 5A:
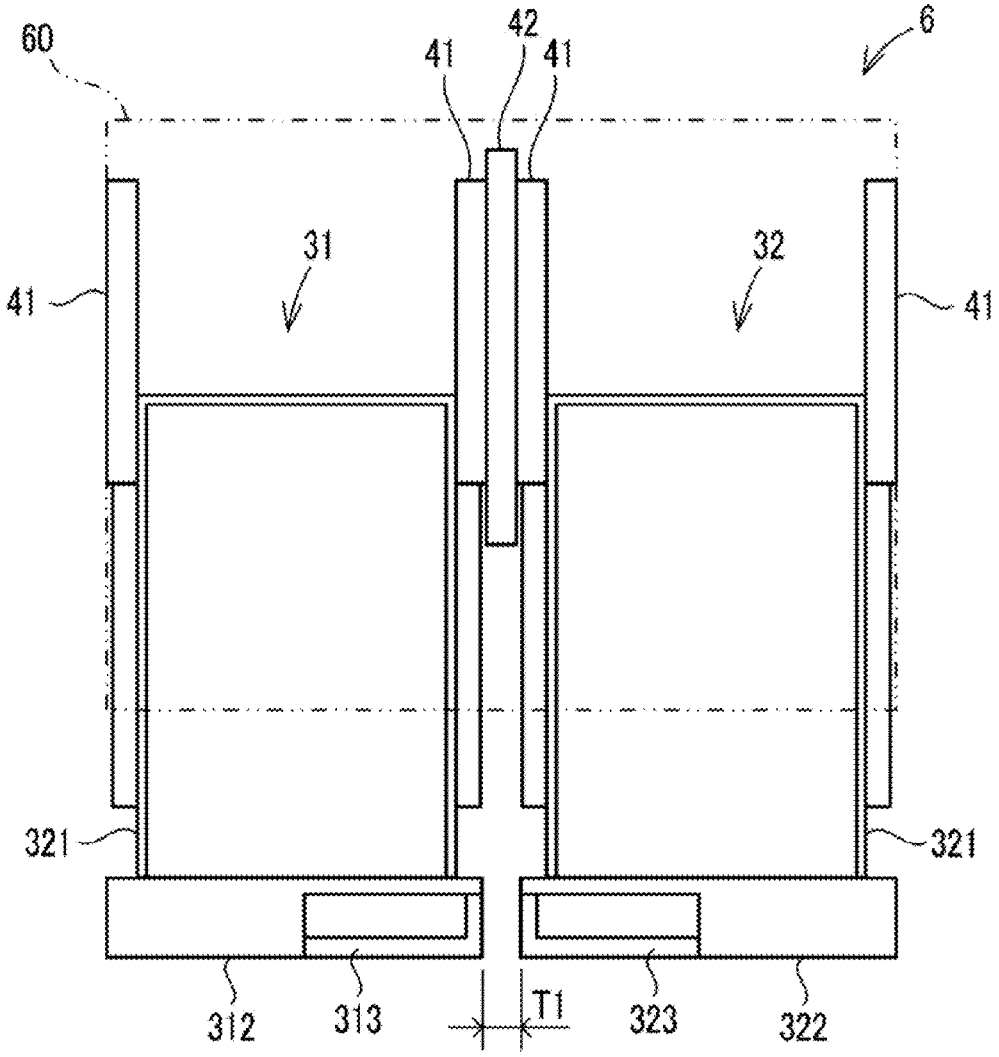
FIG. 5A is a top diagram showing a state where the first and second sheet feed cassettes are drawn out from the housing.
Figure 5B:
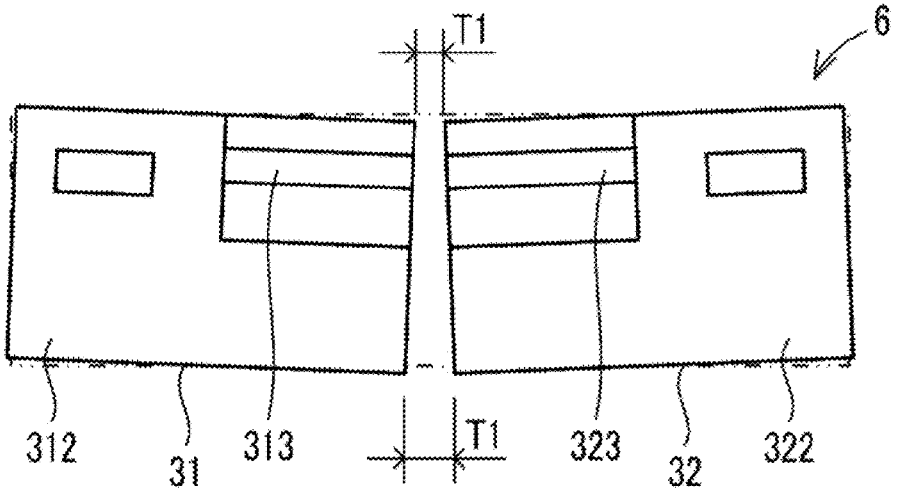
FIG. 5B is a front diagram showing the state where the first and second sheet feed cassettes are drawn out from the housing.

FIG. 5A and FIG. 5B show a state where the first sheet feed cassette 31 and the second sheet feed cassette 32 are drawn out from the housing 60 to the maximum and disposed at the paper sheet storageable positions. FIG. 5A is a schematic diagram showing the sheet stacking device 6 viewed from above. FIG. 5B is a schematic diagram showing the sheet stacking device 6 viewed from the front. In a case where the first sheet feed cassette 31 and the second sheet feed cassette 32 are supported by the slide support portions 41 described above, a center portion of the bottom surface of the housing 60 may be bent downward by the weights of the first sheet feed cassette 31 and the second sheet feed cassette 32, as shown in FIG. 5B. Specifically, the load of the first sheet feed cassette 31 and the second sheet feed cassette 32 due to the gravity is applied to the leg portion 42, and the center portion of the bottom surface of the housing 60 is bent downward. In this case, upper end portions of the front panels 312 and 322 come close to each other, and lower end portions thereof are mutually separated. As a result, the interval of the gap T1 between the upper end portions of the front panels 312 and 322 becomes narrow, and the upper end portions may contact each other due to the above-described errors and looseness.

Figure 6:
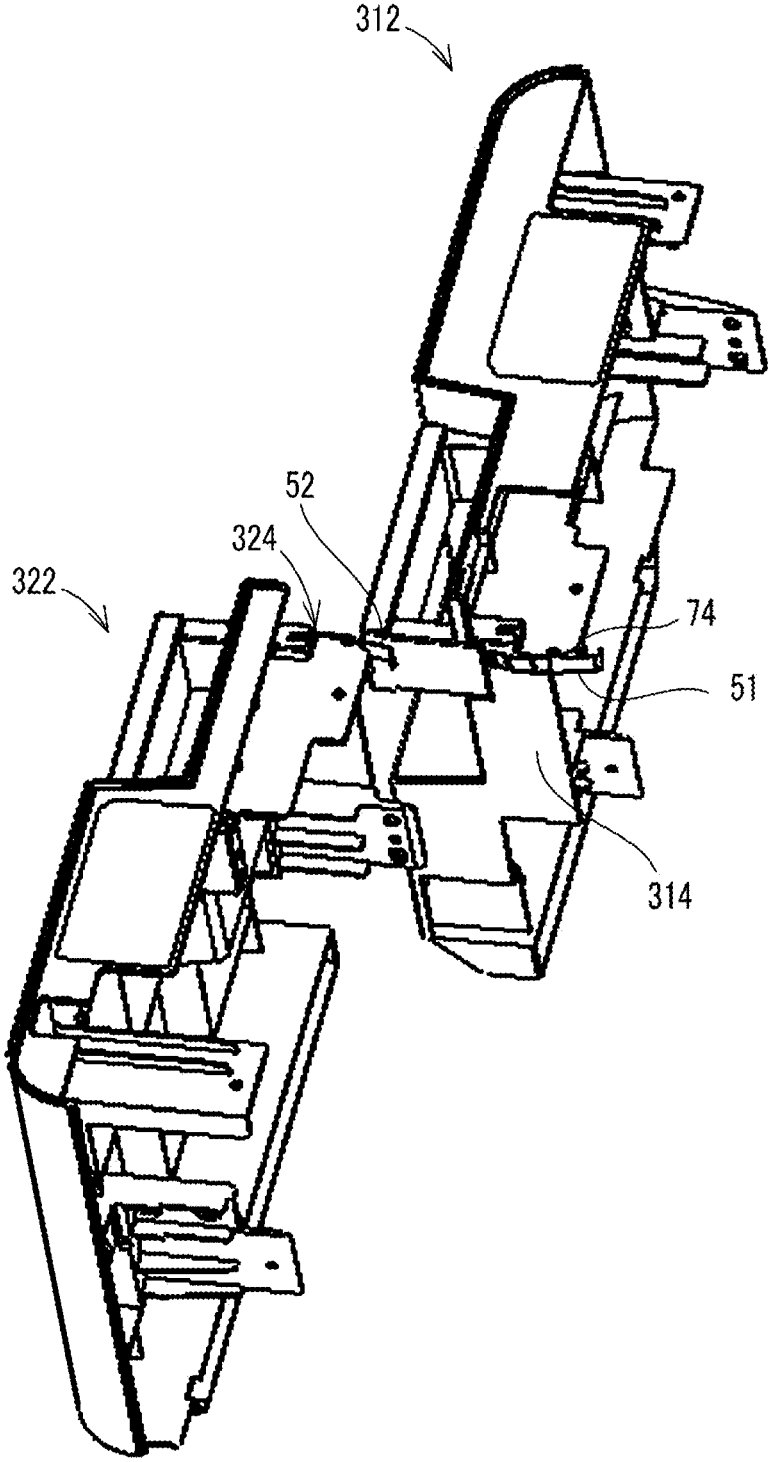
FIG. 6 is a perspective diagram showing front panels of the first and second sheet feed cassettes.
Figure 7:
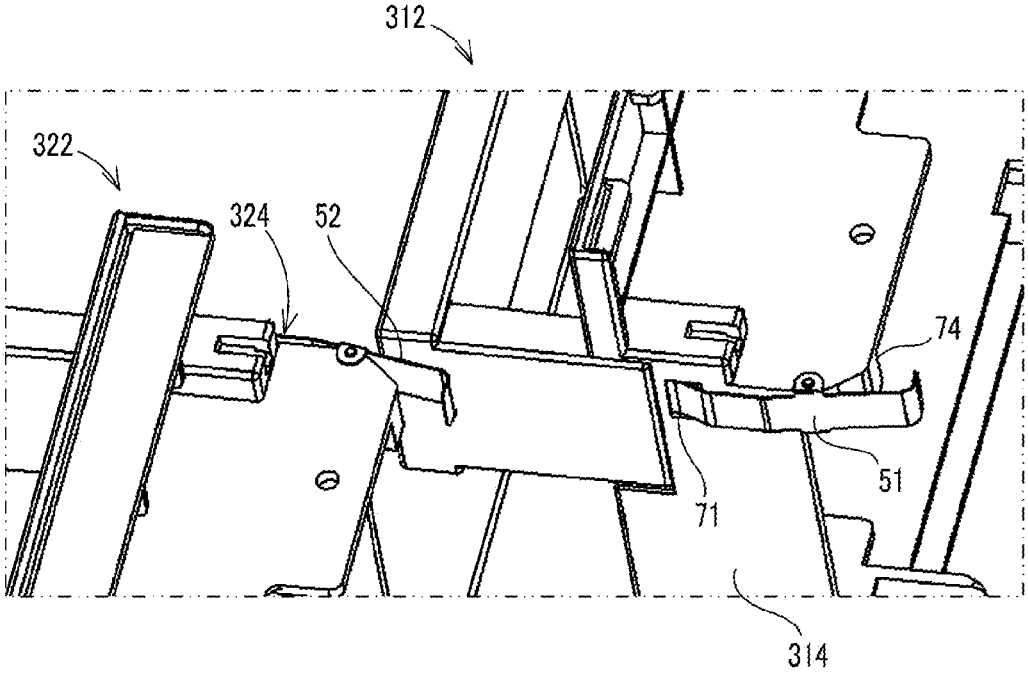
FIG. 7 is a partial enlargement diagram showing biasing members provided on the front panels of the first and second sheet feed cassettes.

In the present embodiment, in order to solve the above-described problem, as shown in FIG. 6 and FIG. 7, a first biasing member 51 is provided on the front panel 312, and a second biasing member 52 is provided on the front panel 322. The first biasing member 51 and the second biasing member 52 are an example of the biasing members of the present disclosure.

As shown in FIG. 6 and FIG. 7, the first biasing member 51 is provided on a side surface 314 (an example of the opposite side surfaces) of the front panel 312 of the first sheet feed cassette 31, wherein the side surface 314 faces a side surface 324 of the other front panel 322 that is on the front panel 312 side. In addition, the second biasing member 52 is provided on the side surface 324 (an example of the opposite side surfaces) of the front panel 322 of the second sheet feed cassette 32, wherein the side surface 324 faces the side surface 314 of the other front panel 312 that is on the front panel 322 side. In the present embodiment, the first biasing member 51 is provided on the side surface 314 above the slide rails 411 of the slide support portions 41. Specifically, the first biasing member 51 is provided on an upper end portion of the side surface 314. In addition, the second biasing member 52 is provided on the side surface 324 above the slide rails 411 of the slide support portions 41. Specifically, the second biasing member 52 is provided on an upper end portion of the side surface 324 at the same height position as the first biasing member 51. That is, the first biasing member 51 and the second biasing member 52 are provided to be adjacent to each other in the width direction of the sheet stacking device 6. The first biasing member 51 and the second biasing member 52 are composed to abut on each other and bias the front panel 322 and the front panel 312 respectively outward in the width direction of the sheet stacking device 6 so as to separate them from each other.

In the following, a detailed description is given of a configuration of the first biasing member 51 provided on the front panel 312 of the first sheet feed cassette 31. It is noted that the second biasing member 52 has the same configuration as the first biasing member 51 except for the mounting orientation, and thus the same reference signs as those of the first biasing member 51 are assigned to the second biasing member 52 and description of the configuration of the second biasing member 52 is omitted.

Figure 8:
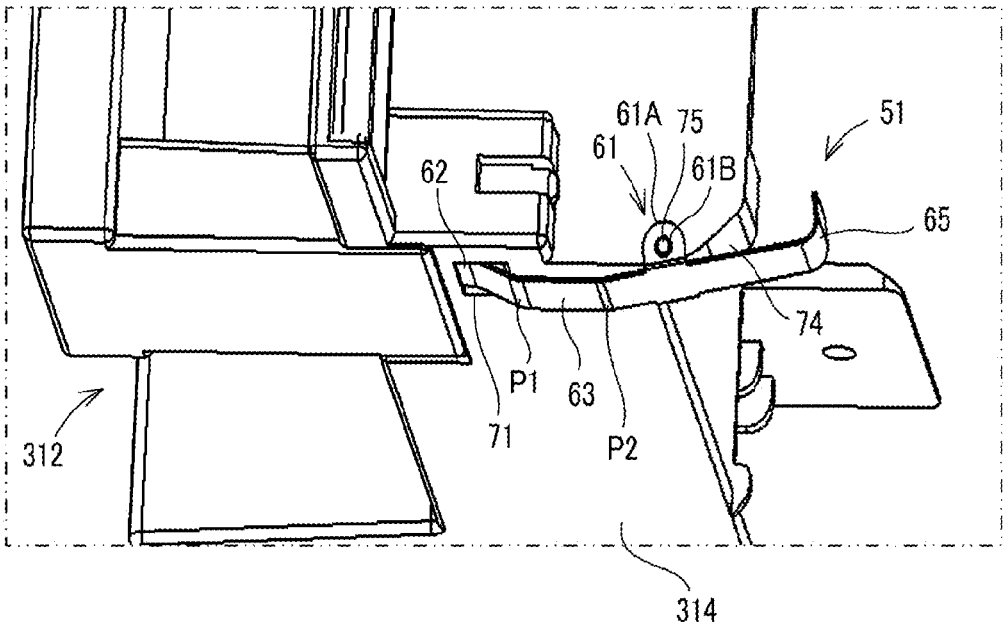
FIG. 8 is a partial enlargement diagram showing the biasing member provided on the front panel of the first sheet feed cassette.

FIG. 8 is an enlargement diagram showing the first biasing member 51 attached to the front panel 312 of the first sheet feed cassette 31. As shown in FIG. 8, the first biasing member 51 is a plate-like member elongated in the front-rear direction of the sheet stacking device 6. The first biasing member 51 may be formed from synthetic resin or a sheet metal. The first biasing member 51 includes a swing fulcrum portion 61 (an example of the first support portion), an engaging end portion 62 (an example of the second support portion), and a bent portion 63 (an example of the bent portion).

Figure 9A:
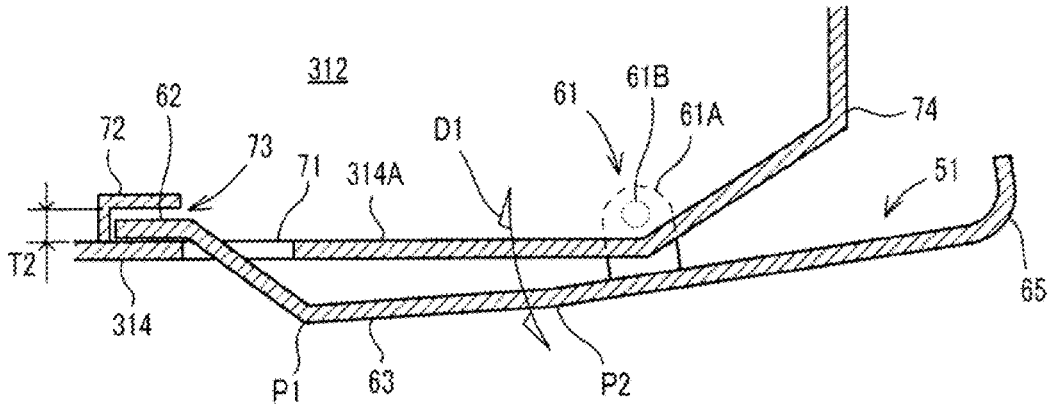
FIG. 9A to FIG. 9C are schematic cross-sectional diagrams showing the biasing member provided on the front panel of the first sheet feed cassette.

The engaging end portion 62 is engaged with and supported by the side surface 314 of the front panel 312, at a predetermined position on the first biasing member 51 that is more on the front side than the swing fulcrum portion 61. Specifically, a front end portion of the first biasing member 51 is the engaging end portion 62. The side surface 314 has a rectangular through hole 71 (an example of the opening) that pierces through the side surface 314 to the inside of the front panel 312. The engaging end portion 62 is inserted in the through hole 71. A hook-like engaging piece 72 (an example of the engaging portion, see FIG. 9A) is formed on a back surface 314A (see FIG. 9A) of the side surface 314, at a position that is more on the front side than the through hole 71. A predetermined gap T2 is formed between the engaging piece 72 and the back surface 314A, and the engaging piece 72 has, on the rear side thereof, an insertion hole 73 that communicates with the gap. As shown in FIG. 9A, the engaging end portion 62 is passed through the through hole 71 diagonally frontward and inserted in the gap T2 from the insertion hole 73, and is engaged with the engaging piece 72. It is noted that the gap T2 is larger than the thickness of the engaging end portion 62. As a result, the gap T2 has looseness in a state where the engaging end portion 62 is inserted in the gap T2, and the engaging end portion 62 can be displaced in the gap T2 in a direction vertical to the back surface 314A.

The swing fulcrum portion 61 is supported by the side surface 314 at a predetermined position that is more on the rear side than the engaging end portion 62. Specifically, the swing fulcrum portion 61 includes a pair of projection pieces 61A that project toward the side surface 314 from ends of the first biasing member 51 that are opposite in the up-down direction. The pair of projection pieces 61A have bearing holes 61B respectively. In addition, the front panel 312 includes a protruding portion 74 (see FIG. 8 and FIG. 9A) that protrudes rearward from an upper rear end of the side surface 314. A cylindrical boss 75 (an example of the rotation shaft) is formed on each of the upper and lower surfaces of the protruding portion 74. The pair of projection pieces 61A are attached to the bosses 75 as the bosses 75 are inserted in the bearing holes 61B. This allows the swing fulcrum portion 61 to be swingably supported by the side surface 314.

With the engaging end portion 62 engaged with the engaging piece 72, and the projection pieces 61A of the swing fulcrum portion 61 attached to the bosses 75, the first biasing member 51 is attached to the side surface 314. As described above, the gap T2 of the engaging piece 72 with which the engaging end portion 62 is engaged has looseness. As a result, when the engaging end portion 62 is displaced in the gap T2, the first biasing member 51 swings around the swing fulcrum portion 61 in a direction indicated by an arrow D1 (see FIG. 9A), by a rotation amount corresponding to an amount of the displacement.

The bent portion 63 is provided between the engaging end portion 62 and the swing fulcrum portion 61. The bent portion 63 is formed by bending a material toward the side surface 314 at two bending points P1 and P2 that are separate from each other in the longitudinal direction of the first biasing member 51. As shown in FIG. 9A, the bent portion 63 is formed in a bent shape to be separate from the side surface 314. With such a configuration, in the first biasing member 51, the bent portion 63 acts as a plate spring that is elastic in the direction vertical to the side surface 314 in a state where the engaging end portion 62 and the swing fulcrum portion 61 are supported by the side surface 314. In other words, the bent portion 63 is a plate spring portion (elastic member) that is elastic like a plate spring.

The first biasing member 51 extends rearward straight from the bending point P2 of the bent portion 63 in a direction slightly inclined toward the side surface 314. In addition, at a rear end portion of the first biasing member 51, a curved portion 65 is formed in the shape of an arc curved toward the side surface 314. That is, the rear end portion of the first biasing member 51 is the curved portion 65.

Figure 9B:
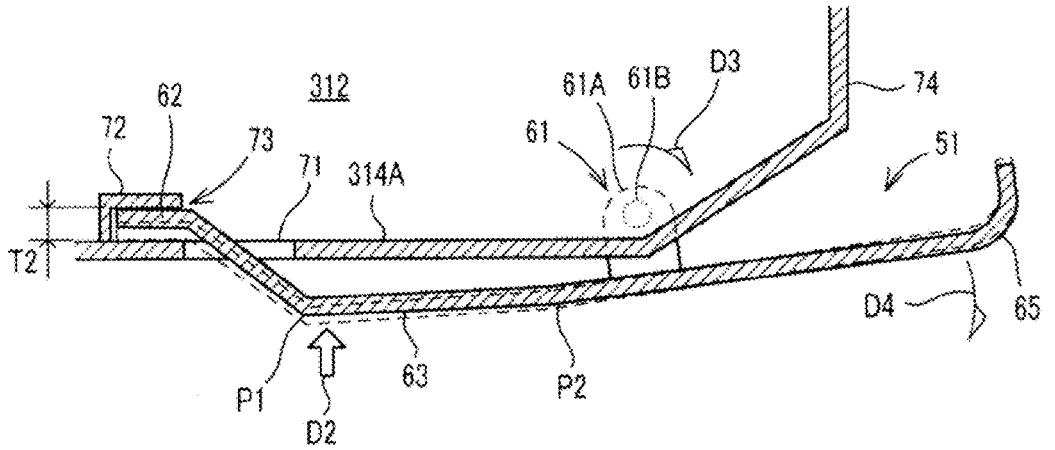
Figure 9C:
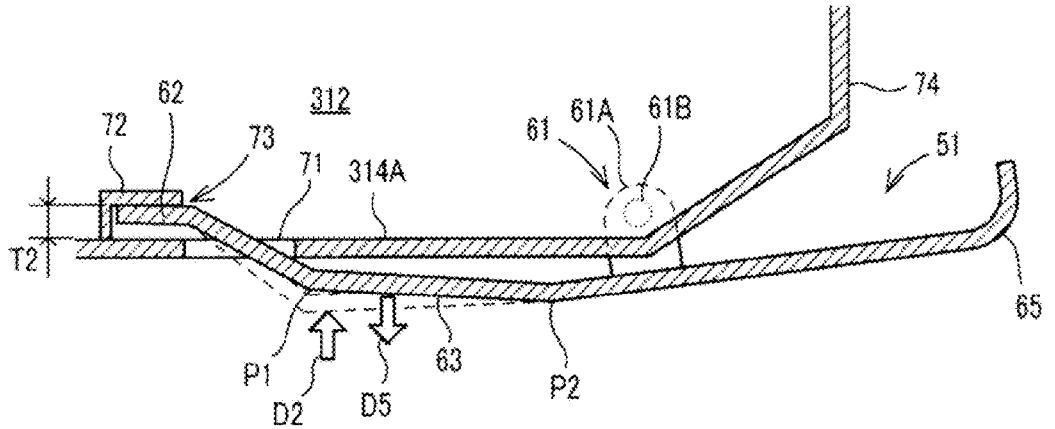

Next, an operation of the first biasing member 51 attached to the front panel 312 is described with reference to FIG. 9A to FIG. 9C. Here, FIG. 9A to FIG. 9C are schematic cross-sectional diagrams showing cross-sectional structures of the first biasing member 51, taken along a horizontal cut plane that passes through the center of the first biasing member 51 in the up-down direction shown in FIG. 8.

FIG. 9A shows a state where no external force is applied to the first biasing member 51. In the state shown in FIG. 9A, the first biasing member 51 can swing around the swing fulcrum portion 61 in the direction indicated by the arrow D1, in a range in which the engaging end portion 62 can be displaced in the gap T2. On the other hand, as shown in FIG. 9B, when a predetermined pressing force is applied to the bent portion 63 in the direction of the arrow D2, the first biasing member 51 moves toward the side surface 314 by a very short distance. Specifically, the first biasing member 51 moves until the engaging end portion 62 in the gap T2 abuts on the inner surface of the engaging piece 72. At this time, the first biasing member 51 slightly rotates around the swing fulcrum portion 61 in a direction indicated by an arrow D3, and the curved portion 65 is displaced in a direction of going away from the side surface 314 (in a direction indicated by an arrow D4). Furthermore, as shown in FIG. 9C, when the pressing force is further applied to the bent portion 63 in the direction of the arrow D2, the bent portion 63 is elastically deformed and displaced toward the side surface 314. At this time, a reaction force is generated in the bent portion 63 in a direction of an arrow D5 that is opposite to the direction of the arrow D2.

In the present embodiment, the first biasing member 51 that acts as described above, is attached to the side surface 314 of the front panel 312, and the second biasing member 52 that acts similarly is attached to the side surface 324 of the front panel 322. In the following, a description is given of operations of the first biasing member 51 and the second biasing member 52, with reference to FIG. 10 to FIG. 12.

Figure 10:
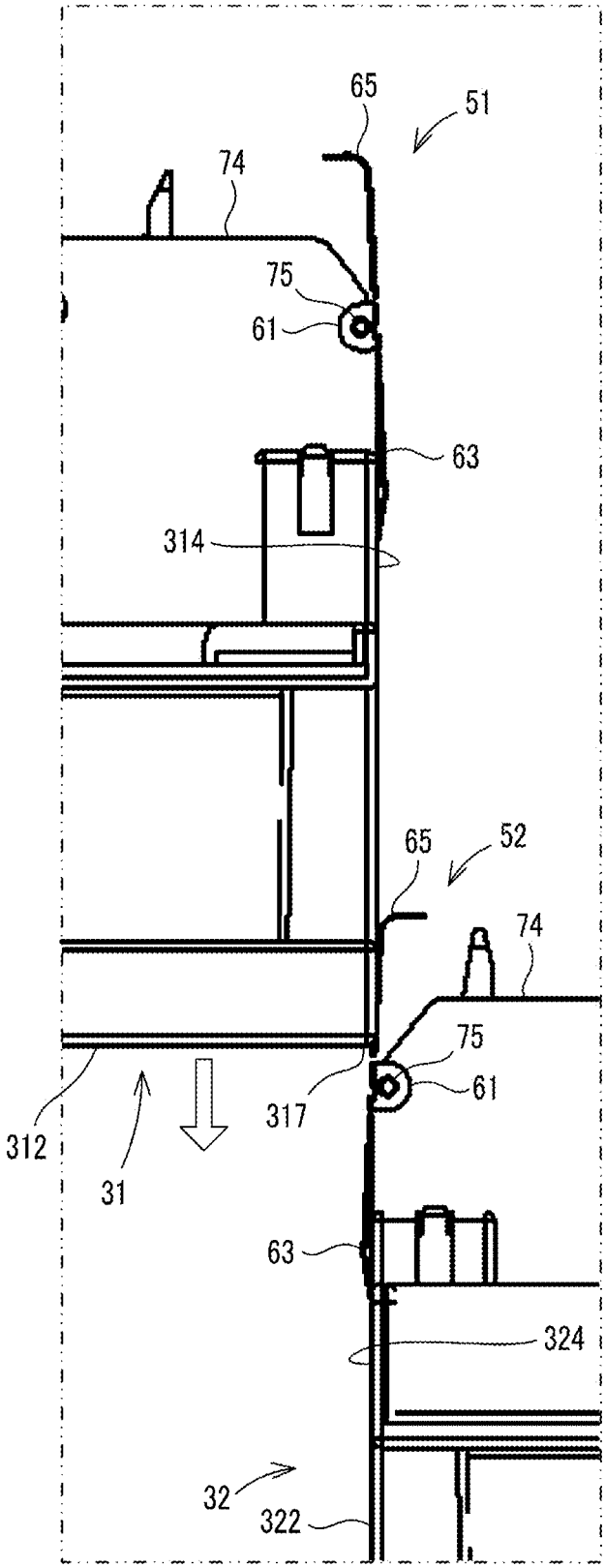
FIG. 10 is a partial enlargement diagram showing positional relationship between the front panels in a case where the first sheet feed cassette is drawn out frontward from an attachment position while the second sheet feed cassette is disposed at a paper sheet storageable position.

FIG. 10 is a diagram showing positional relationship between the front panels 312 and 322 in a case where the first sheet feed cassette 31 is drawn out frontward from the attachment position in the housing 60 in a state where the second sheet feed cassette 32 is disposed at the paper sheet storageable position. During a process in which the first sheet feed cassette 31 is drawn out and the front panel 312 is displaced frontward, the corner portion 317 of the front panel 312 at its right front end abuts on the curved portion 65 of the second biasing member 52 of the front panel 322. As described above, the curved portion 65 has a curved surface that is curved in the shape of an arc. As a result, when the corner portion 317 of the front panel 312 abuts on the curved portion 65, the corner portion 317 is guided frontward smoothly along the curved surface. At this time, the second biasing member 52 is bent by being pressed toward the second sheet feed cassette 32 by the corner portion 317 of the front panel 312, and by an elastic force that is generated at this time, biases the front panel 312 and the front panel 322 respectively outward in the width direction so as to separate them from each other. With this configuration, even if the first sheet feed cassette 31 and the second sheet feed cassette 32 are shifted inward in the width direction, the corner portion 317 of the front panel 312 does not collide with the front panel 322, and the first sheet feed cassette 31 is drawn out frontward smoothly.

Figure 11:
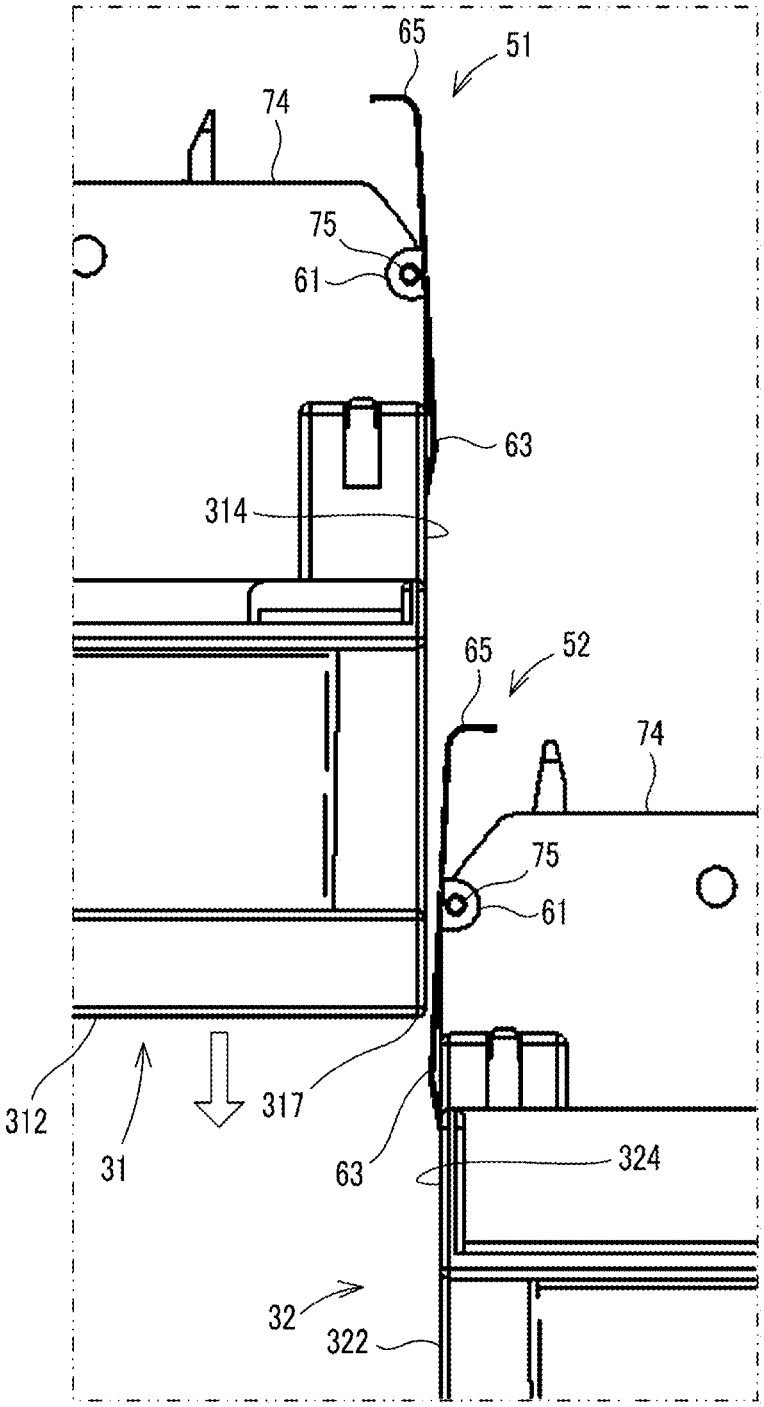
FIG. 11 is a partial enlargement diagram showing positional relationship between the front panels in a case where the first sheet feed cassette is further drawn out frontward from the state shown in FIG. 10.

As shown in FIG. 11, when the first sheet feed cassette 31 is further drawn out frontward, and the corner portion 317 reaches the bent portion 63 of the second biasing member 52, the corner portion 317 presses the bent portion 63 toward the side surface 324. When the pressing force at this time is large enough to elastically deform the bent portion 63 of the second biasing member 52 toward the side surface 324, the bent portion 63, upon receiving the pressing force, generates a reaction force in a direction opposite to the pressing force. This reaction force acts as a force that biases the front panel 312 and the front panel 322 outward respectively in the width direction. Upon receiving the reaction force, the front panels 312 and 322 are separated in the width direction, and a gap is generated between the side surface 314 of the front panel 312 and the side surface 324 of the front panel 322.

Figure 12:
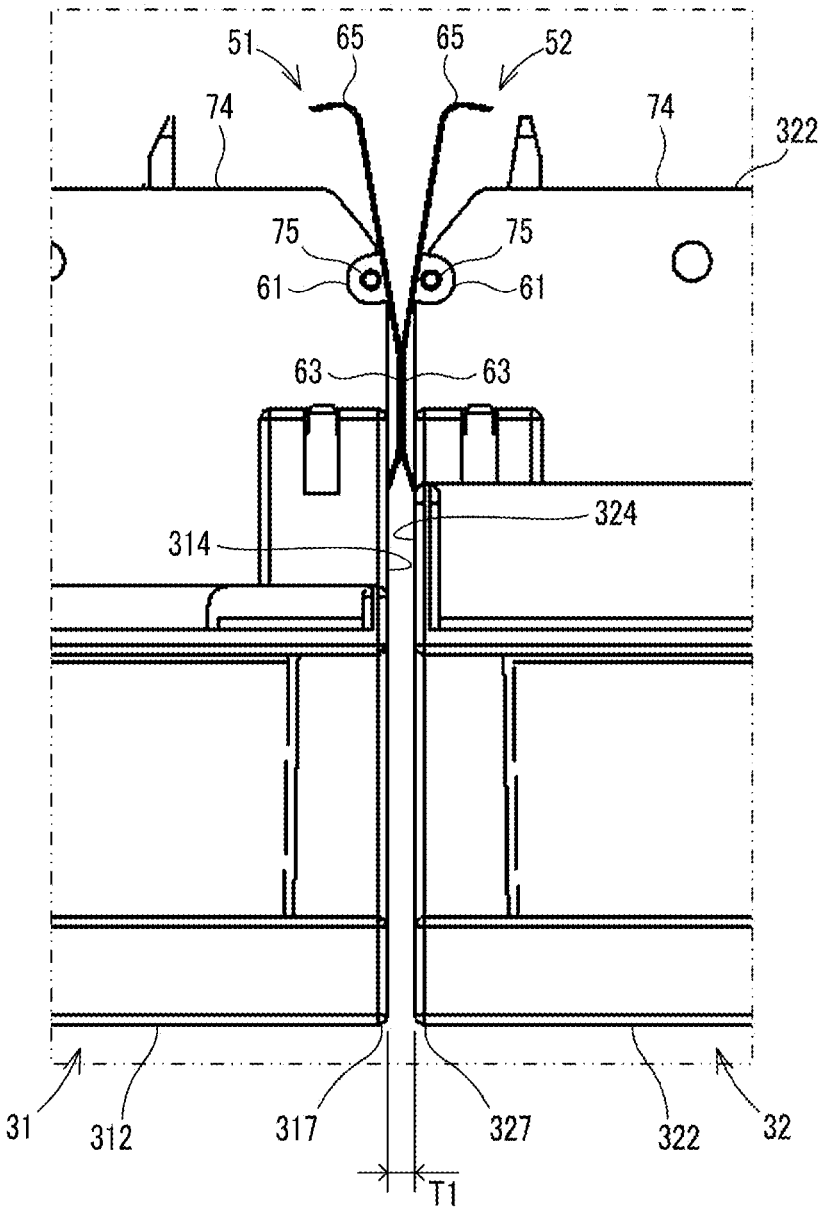
FIG. 12 is a partial enlargement diagram showing positional relationship between the front panels in a case where the first sheet feed cassette is further drawn out frontward from the state shown in FIG. 11, and both the first and second sheet feed cassettes are drawn out to the paper sheet storageable positions.

As shown in FIG. 12, when the first sheet feed cassette 31 is further drawn out and both the first sheet feed cassette 31 and the second sheet feed cassette 32 are drawn out to the paper sheet storageable positions, the first biasing member 51 of the front panel 312 and the second biasing member 52 of the front panel 322 abut on each other. At this time, the bent portions 63 of them abut on each other. As described above, the bent portions 63 act as plate springs. As a result, when the bent portions 63 abut on each other, the front panels 312 and 322 are biased by the spring forces of the bent portions 63, respectively outward in the width direction. As a result, the gap T1 having an appropriate interval is formed between the corner portion 317 of the front panel 312 and a corner portion 327 of the front panel 322 at its left front end.

It is noted that when both the first sheet feed cassette 31 and the second sheet feed cassette 32 are disposed at the attachment positions and stored in the housing 60, the first sheet feed cassette 31 and the second sheet feed cassette 32 are made close to each other slightly inward in the width direction by a positioning member (not shown), and are positioned so that the gap T1 has the predetermined interval (for example, 2 mm). In this case, the bent portions 63 of the first biasing member 51 and the second biasing member 52 are elastically deformed toward the side surface 314 and the side surface 324, compared to the state immediately before they are positioned at the attachment positions, and the first biasing member 51 and the second biasing member 52 are slightly pivoted in the direction of the arrow D4 (see FIG. 9B).

As described above, in the sheet stacking device 6 of the present embodiment, the first biasing member 51 is provided on the front panel 312, and the second biasing member 52 is provided on the front panel 322. Accordingly, even when the first sheet feed cassette 31 and the second sheet feed cassette 32 are shifted in the width direction when they are drawn out, due to a mounting error of the slide support portions 41, a mounting error of the front panels 312 and 322 with respect to the paper sheet storage portions 311 and 321, and looseness of the slide support portions 41, the front panels 312 and 322 are prevented from contacting and interfering with each other. As a result, it is always possible to draw out and insert the first sheet feed cassette 31 and the second sheet feed cassette 32 smoothly from/into the housing 60 regardless of the positions of the first sheet feed cassette 31 and the second sheet feed cassette 32.

It is noted that in the present embodiment, an example case where the engaging end portion 62 is engaged in a state where the gap T1 of the engaging piece 72 has looseness. However, the gap T1 does not necessarily have looseness. In addition, in the present embodiment, the swing fulcrum portion 61 is provided as an example of the first support portion. However, the first biasing member 51 and the second biasing member 52 are not limited to being swingably supported, but may be fixed to the front panels 312 and 322 so as not to swing. In short, the first biasing member 51 and the second biasing member 52 may have any configuration as far as, in a state where they are attached to the front panels 312 and 322, when the first sheet feed cassette 31 and the second sheet feed cassette 32 are drawn out from the housing 60, they abut on each other and bias the front panels 312 and 322 respectively outward in the width direction. In addition, the present embodiment describes an example case where the first biasing member 51 and the second biasing member 52 are respectively attached to the front panel 312 and the front panel 322. However, the first biasing member 51 and the second biasing member 52 may be respectively provided on side surfaces of the paper sheet storage portions 311 and 321, the side surfaces being adjacent to each other and facing each other in the width direction of the paper sheet storage portions 311 and 321.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet stacking device comprising:

a housing;

a first sheet storage portion and a second sheet storage portion arranged in alignment in a width direction of the housing, and supported by the housing so as to move in a front-rear direction perpendicular to the width direction;

opposite side surfaces which include a side surface of the first sheet storage portion and a side surface of the second sheet storage portion and the side surface of the first sheet storage portion and the side surface of the second sheet storage portion are adjacent and face each other in the width direction;

a first front panel and a second front panel, the first front panel being provided on a front surface of the first sheet storage portion, the second front panel being provided on a front surface of the second sheet storage portion, a side surface of the first front panel and a side surface of the second front panel constituting a front portion of the opposite side surfaces; and biasing members respectively provided on the side surface of the first front panel and the side surface of the second front panel, wherein in a first state where the first sheet storage portion and the second sheet storage portion are moved frontward from the housing, the biasing members abut on each other to bias the first sheet storage portion and the second sheet storage portion in directions in which the first sheet storage portion and the second sheet storage portion separate from each other along the width direction, each of the biasing members is a plate-like elastic member elongated in the front-rear direction and includes:

a first support portion supported on one of the opposite side surfaces at a predetermined position;

a second support portion supported on the one of the opposite side surfaces at a predetermined position which is more on a front side than the first support portion; and a bent portion provided between the first support portion and the second support portion to separate from the one of the opposite side surfaces, and when the first sheet storage portion and the second sheet storage portion are in the first state, the biasing members bias the first front panel and the second front panel outward in the width direction by reaction forces directed outward in the width direction, the reaction forces being generated by elastic deformations generated when the bent portions of the biasing members abut on each other.

2. The sheet stacking device according to claim 1, further comprising:

a slide support portion including:

first slide rails respectively provided on a pair of side surfaces of the first sheet storage portion that are opposite to each other in the width direction and parallel to the front-rear direction;

second slide rails respectively provided on a pair of side surfaces of the second sheet storage portion that are opposite to each other in the width direction and parallel to the front-rear direction; and rail guides provided on the predetermined positions where the rail guides face the first slide rails or the second slide rails in the housing and supporting the first and second slide rails to move in the front-rear direction, wherein the slide support portion supports the side surfaces of the first sheet storage portion and the side surfaces of the second sheet storage portion such that the first sheet storage portion and the second sheet storage portion can move in the front-rear direction, and the biasing members are provided above the first and second slide rails in the opposite side surfaces.

3. The sheet stacking device according to claim 1, wherein the first support portion is swingably supported by rotation shafts which are provided on each of the first front panel and the second front panel to extend in an up-down direction.

4. The sheet stacking device according to claim 1, wherein the second support portion is a front end portion of one of the biasing members, and in a state where the front end portion is inserted through an opening that is formed in each of the side surfaces of the first front panel and the second front panel, to a back surface of the side surface, the front end portion is engaged with an engaging portion provided on the back surface.

5. The sheet stacking device according to claim 1, wherein each of the biasing members includes a curved portion at an end portion thereof which is more on a rear side than the first support portion, the curved portion being curved toward inside of the one of the opposite side surfaces.

6. An image forming apparatus comprising:

the sheet stacking device according to claim 1; and an image forming portion configured to form an image on a sheet supplied from the first sheet storage portion or the second sheet storage portion of the sheet stacking device.

7. A sheet stacking device comprising:

a housing;

a first sheet storage portion and a second sheet storage portion arranged in alignment in a width direction of the housing, and supported by the housing so as to move in a front-rear direction perpendicular to the width direction;

opposite side surfaces which include a side surface of the first sheet storage portion and a side surface of the second sheet storage portion and the side surface of the first sheet storage portion and the side surface of the second sheet storage portion are adjacent and face each other in the width direction;

biasing members respectively provided on the opposite side surfaces; and a slide support portion including:

first slide rails respectively provided on a pair of side surfaces of the first sheet storage portion that are opposite to each other in the width direction and parallel to the front-rear direction;

second slide rails respectively provided on a pair of side surfaces of the second sheet storage portion that are opposite to each other in the width direction and parallel to the front-rear direction; and rail guides provided on predetermined positions where the rail guides face the first slide rails or the second slide rails in the housing and supporting the first and second slide rails to move in the front-rear direction, wherein the slide support portion supports the side surfaces of the first sheet storage portion and the side surfaces of the second sheet storage portion such that the first sheet storage portion and the second sheet storage portion can move in the front-rear direction, the biasing members are provided above upper edges of the first and second slide rails in the opposite side surfaces, and in a first state where the first sheet storage portion and the second sheet storage portion are moved frontward from the housing, the biasing members abut on each other to bias the first sheet storage portion and the second sheet storage portion in directions in which the first sheet storage portion and the second sheet storage portion separate from each other along the width direction.

* * * * *